US005997663A

United States Patent [19]

Kita et al.

[11] Patent Number: 5,997,663

[45] Date of Patent: Dec. 7, 1999

[54] NICKEL-FREE COPPER ALLOY

[75] Inventors: Kazuhiko Kita, Sendai; Yasuharu Yoshimura, Kurobe, both of Japan

[73] Assignee: YKK Corporation, Tokyo, Japan

[21] Appl. No.: 09/175,575

[22] Filed: Oct. 20, 1998

[30] Foreign Application Priority Data

Oct. 21, 1997 [JP] Japan ..... 9-288506
Oct. 21, 1997 [JP] Japan ..... 9-288512

[51] Int. Cl.[6] ..... C22C 9/05

[52] U.S. Cl. ..... 148/434; 420/476; 420/477; 420/478

[58] Field of Search ..... 148/434; 420/476, 420/477, 478

[56] References Cited

U.S. PATENT DOCUMENTS 2,185,809 1/1940 Hackley .
2,494,736 1/1950 Berwick .
4,242,133 12/1980 Shapiro et al. ..... 75/157.5

FOREIGN PATENT DOCUMENTS 1050906 4/1991 China .
678586 10/1995 European Pat. Off. .
967018 10/1950 France .
4325217 2/1995 Germany .
57085948 5/1982 Japan .
3232940 10/1991 Japan .
3264630 11/1991 Japan .
619129 3/1949 United Kingdom .

*Primary Examiner*—Sikyin Ip
*Attorney, Agent, or Firm*—Finnegan, Henderson, Farabow, Garrett & Dunner, L.L.P.

[57] ABSTRACT

A nickel-free white or yellowish copper alloy having excellent corrosion resistance, with high degree of whiteness or yellowness, which is non-allergenic and therefore is suitable for use, for example, in elements, sliders, stoppers and the like for a slide fastener. The alloy consists of a composition represented by the general formula I: $Cu_wZn_xMn_y(Al \text{ and/or } Sn)_z$ wherein w, x, y and z denote weight percentages that are within the ranges of $70 \leqq w \leqq 85$, $5 \leqq x \leqq 22$, $7 < y \leqq 15$, and $0 < z \leqq 4$, or by the general formula II: $Cu_wZn_xMn_y(Al \text{ and/or } Sn)_z$ wherein w, x, y and z denote weight percentages that are within the ranges of $70 \leqq w \leqq 85$, $10 \leqq x \leqq 25$, $0 < y \leqq 7$, and $0 < z \leqq 3$, wherein both the above alloys could contain other unavoidable elements. The alloy is in a single α-phase state at room temperature.

4 Claims, 1 Drawing Sheet

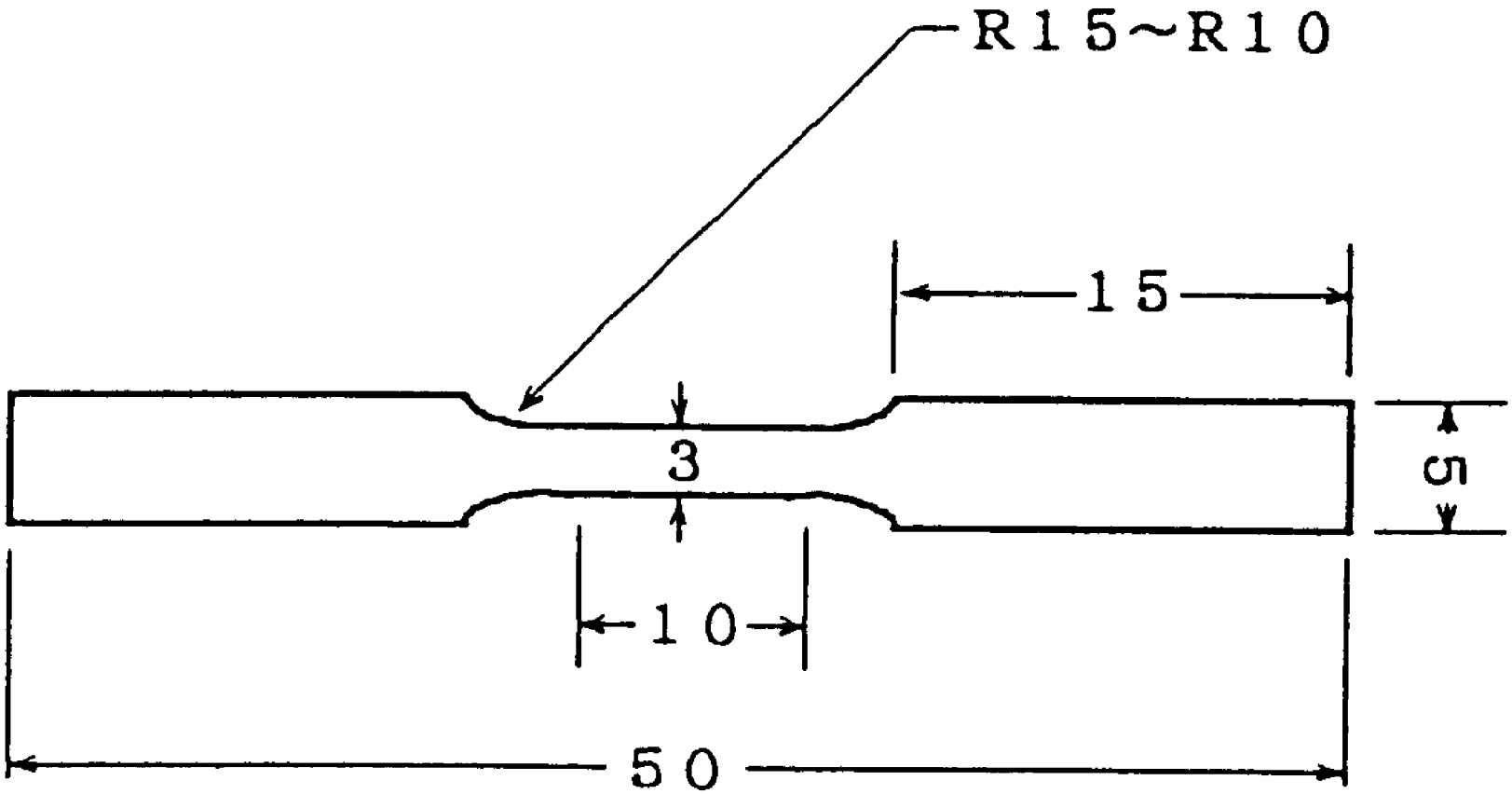
R15~R10
15
3
10
5
50

NICKEL-FREE COPPER ALLOY

BACKGROUND OF THE INVENTION

1. Field of the Invention

The present invention relates to a nickel-free white or yellowish copper alloy having excellent strength, hardness, ductility, workability, and corrosion resistance, as well as a high quality of white or yellow color tone. The copper alloy is non-allergenic and therefore is suitable for use, for example, in elements, sliders, stoppers and the like for slide fasteners, or for ornamental implements such as metallic buttons, clothing fasteners, and the like.

2. Description of the Background Art

Copper alloys that have conventionally been used, for example, in the above-mentioned fasteners include copper-nickel-zinc alloys such as nickel silver that has a white alloy hue, or copper-zinc alloys as represented by red brass, brass, and the like. However, although the nickel-containing nickel silver has excellent corrosion resistance, when it is used in a slide fastener, for example, it causes the problem of nickel allergy because such a fastener often comes in contact with the skin. On the other hand, while the nickel-free copper-zinc alloys as represented by red brass or brass do not pose the problem of nickel allergy, they tend to present a yellowish hue.

Zinc used as the alloy element for such alloys acts to increase the alloy strength, hardness, and uniform deformation through solid solution. Moreover, since zinc is cheaper than copper, it contributes to the provision of an inexpensive alloy having excellent characteristics. Meanwhile, nickel silver has excellent corrosion resistance thanks to the nickel contained therein.

However, the presence of elemental zinc in copper tends to significantly degrade corrosion resistance of the material, causing the problem of season cracking as a result of residual working strain, particularly when a copper alloy rich in zinc content is cold-formed and planted onto a base fabric to make a fastener. Meanwhile, although nickel as an alloy element contained in nickel silver acts to improve the working stress resistance over copper-zinc alloys, it is more expensive and poses the problem of allergic reactions. It is noted that there have been numerous references reporting cases where problems due to dezincing can be improved by adding small quantities of arsenic or tin. There have also been reports that annealing has resulted in significant improvement in stress corrosion cracking, or further that an extended stress corrosion cracking life has been enabled by addition of minute quantities of various elements.

However, it has generally been considered in the prior art that there are few effective means of preventing season cracking which occurs even without a stress load depending on conditions of use, when the material is cold formed with residual strain.

SUMMARY OF THE INVENTION

Accordingly, an object of the present invention is to provide copper alloys having excellent strength and hardness comparable to that of nickel silver, with excellent ductility, workability and corrosion resistance, as well as no allergenic problems, due to the absence of nickel in its constituents.

A further object of the present invention is to provide a white or yellowish copper alloy of specific composition with a desired white or yellowish color tone as well as an advantageous combination of the above-mentioned excellent properties and, in particular, to provide a copper alloy suitable for use in fasteners.

According to the present invention, there is provided a nickel-free white copper alloy consisting of a composition represented by the general formula I:

$$Cu_wZn_xMn_y(\text{Al and/or Sn})_z$$

wherein w, x, y and z denote weight percentages that are within the ranges of $70 \leqq w \leqq 85$, $5 \leqq x \leqq 22$, $7 < y \leqq 15$, and $0 < z \leqq 4$, and unavoidable elements.

The above-mentioned alloy is in a single α-phase state at room temperature, and the a* and b* values indicating a chromaticity are within the ranges of $0 < a^* < 2$ and $7 < b^* < 16$.

The present invention further provides a nickel-free yellowish copper alloy consisting of a composition represented by the general formula II:

$$Cu_wZn_xMn_y(\text{Al and/or Sn})_z$$

wherein w, x, y and z denote weight percentages that are within the ranges of $70 \leqq w \leqq 85$, $10 \leqq x \leqq 25$, $0 < y \leqq 7$, and $0 < z \leqq 3$, and unavoidable elements.

Such an alloy has a mainly yellowish hue with the a* and b* values indicating a chromaticity within the ranges of $-1.0 < a^* < 3$ and $13 < b^* < 26.0$, and is in a single α-phase state at room temperature.

BRIEF DESCRIPTION OF THE DRAWING

The single drawing shows the shape and dimensions of a test piece for the tensile test to be used in accordance with the present invention.

DETAILED DESCRIPTION OF THE PREFERRED EMBODIMENTS

In the compositions of the present invention, Zn acts to improve the mechanical characteristics of the alloy through solid solution strengthening effect, as well as to reduce the cost of the alloy.

A suitable range for the Zn content in the present invention varies depending on the composition of the alloy comprising the Zn element. Namely, in an alloy represented by the general formula I, both the cost reduction effect and the strengthening effect become insufficient at a Zn content of less than 5%. On the other hand, at a Zn content of more than 22%, season cracking resistance will be adversely affected and, in addition, acquisition of adequate cold workability will become difficult as the crystalline structure proceeds to an α+β phase.

In an alloy represented by the general formula II, the cost reduction effect and the strengthening effect become insufficient at a Zn content of less than 10%. Meanwhile, at a Zn content of more than 25%, season cracking resistance will deteriorate and, in addition, adequate cold workability will become unavailable as the crystalline structure proceeds to an α+β phase. Moreover, the color tone of the alloy will become more whitish.

In the compositions of the present invention, Mn acts to improve the mechanical characteristics of the alloy through solid solution strengthening effect, as well as to reduce the cost of the alloy. Moreover, addition of Mn in the above-specified amount as partial replacement of Zn has the effect of improving season cracking resistance as well as preventing the alloy hue from becoming excessively yellowish. It also has an effect in lowering the melting point of the alloy, thus improving the castability and suppressing the vaporization of Zn from the molten metal.

The suitable Mn content is adjusted depending on the desired hue of the alloy. Namely, in an alloy represented by the general formula I aiming at a whitish hue, an Mn content of 7% or less will make the hue yellowish. Conversely, at an Mn content of more than 15%, cold workability of the alloy will become inadequate as the crystalline structure proceeds to an $\alpha+\beta$ phase. In the case where only Al is selected from the (Al and/or Sn) given in the formula, it is preferable to limit the Mn content to a maximum of 10%.

However, in an alloy represented by the general formula II aiming at a yellowish hue, the Mn content must be 7% or less because an Mn content over 7% will give a whitish hue. Nonetheless, the content must be more than 0% to obtain the aforementioned effects on the Zn component of the alloy.

The Al and/or Sn components of the alloy act to improve season cracking resistance that is required for a fastener by forming a stable oxide coating on the surface of the alloy. These components also have the effect of improving mechanical characteristics of the alloy through solid solution strengthening effect, as well as reducing the cost of the alloy. Although the minimum required content is any level greater than 0%, the lowest level is preferably 0.2% since too low a content will render the season cracking resistance of the alloy inadequate and the strengthening effect insufficient. Meanwhile, with an Al and/or Sn content of more than 4% in an alloy represented by the general formula I, or more than 3% in an alloy represented by the general formula II, an adequate cold workability will become unavailable as the crystalline structure proceeds to an $\alpha+\beta$ phase.

The alloy of the present invention has a single $\alpha$-phase structure to provide an adequate cold workability. However, the crystalline structure of alloys outside of the compositional ranges specified in the present invention has a tendency to turn to an $\alpha+\beta$ phase, thus adversely affecting the workability.

The chromaticity of the alloy of the present invention represented by the general formula I is within the ranges of $0<a^*<2$ and $7<b^*<16$ based on the L*a*b* color system chromaticity diagram as defined in JIS Z 8729. As defined in JISZ 8729, a* and b* are psychometric chroma coordinates, i.e., two coordinates in three dimensional colour space having, perceptionally, approximately uniform degree, that are obtained by using tristimulus values in the XYZ system X, Y, and Z from the following formulae:

$$a^* = 500[(X/X_n)^{1/3} - (Y/Y_n)^{1/3}] \quad \text{where } X/X_n > 0.008856$$

$$b^* = 200[(Y/Y_n)^{1/3} - (Z/Z_n)^{1/3}] \quad Y/Y_n > 0.008856$$

$$Z/Z_n > 0.008856$$

and where X, Z, and Z are tristimulus values in the XYZ system and $X_n$, $Y_n$, and $Z_n$ are tristimulus values in the XYZ system of perfect reflecting diffuser. And, wherein, X, Y, and Z are determined as set forth in JIS Z 8701 such that $$x = k\int_{380}^{780} S(\lambda)x(\lambda)\,d(\lambda)$$

$$y = k\int_{380}^{780} S(\lambda)y(\lambda)\,d(\lambda)$$

$$z = k\int_{380}^{780} S(\lambda)z(\lambda)\,d(\lambda)$$

where $S(\lambda)$: relative spectral power distribution of radiant quantity from light-source $x(\lambda)$, $y(\lambda)$, $z(\lambda)$: colour matching functions for XYC colour system, the values for which can be found in JIS Z 8701, Table 1.

k: proportional ratio, this shall be determined so that the value Y of the tristimulus values may meet the luminous quantity.

Note that the chromaticity mentioned in the present specification is indicated by the psychometric lightness L* (Lightness; L-star) and psychometric chroma coordinates, i.e. a* (greenish hue to reddish hue; a-star) and b* (bluish hue to yellowish hue; b-star), expressed in accordance with the method of indicating an object color as specified in JIS Z 8729. In particular, in order for an alloy to present the whitish hue as the characteristic of the present invention, it is preferred to present a nearly achromatic color, which can be defined by the chroma coordinates a* and b* as provided in the above.

In order for the chromaticity of the alloy of the present invention represented by the general formula II to be the characteristic yellow, the a* is preferably near achromatic while b* is to be incremented and specified within the ranges of $-1.0<a^*<3$ and $13<b^*<26.0$, as previously mentioned.

Embodiment 1

Using pure Cu (99.9%), pure Zn (99.9–99.99%), pure Mn (99.9%), pure Al (99.99%), and pure Sn (99.95%), batches of desired compositions for making up a 200 $cm^3$ ingot were prepared. The numerical values indicated within parentheses are purities of the respective metals. The batches were melted in a high-frequency induction furnace in an argon atmosphere (100 mmHg) and, after holding for 4 minutes, poured into a copper casting mold (ø40 mm×28 mm). The ingots thus obtained (200 $cm^3$) were cut to a length of approximately 70 mm to make billets for extrusion. The billets were subjected to extrusion at a billet temperature of 800° C. and a container temperature of 600° C. The resultant extruded materials (ø8 mm×1300 mm) were heat-treated at 800° C. for an hour followed by cooling in the furnace (the sequence is hereafter referred to as "heat treatment"). The treated extruded materials (wire) were used to prepare test pieces.

Test pieces for the compression test were prepared by cutting out a cylindrical form (ø5 mm×7.5 mm) from the extruded materials after heat treatment by machining on a lathe. The test was conducted at room temperature with a crosshead speed of 0.0016 mm/min (strain rate: $0.4\times10^{-7}$/s) and the compression applied in the longitudinal direction of the test piece. To remove friction with the compressing jig, lubricant was applied to the surface of the test pieces receiving the compression.

For evaluation of season cracking resistance, test pieces were prepared by cutting out a cylinder (ø7 mm×12 mm) from the extruded materials after heat treatment, with lathe machining, followed by cold rolling applying the same degree of working strain (80%) required in preparing the Y-bar (string shaped material providing for slide fastener elements) to a strip with a thickness of 1.2 mm. The strip was then machined into a tensile test piece of the shape shown in the drawing. In this drawing, dimensions are shown in millimeter units.

Using the tensile test pieces as above, elongation percentage was measured. Separately, elongation percentage after exposure to ammonia was measured in accordance with procedures provided in the Japan Brass Makers Association (JBMA) Technical Standard JBMA-T301, using a 12.5% aqueous ammonia solution. The season cracking resistance (rate of elongation reduction) was calculated from the above measurement results.

The tested alloys and test results of the examples of the present invention, as well as comparative examples, are given in Table 1.

TABLE 1

| | Alloy compositions (wt. %) | Compression Strength 0.2% (MPa) | Phase | Season cracking resistance (rate of elongation reduction) % | Hue | a* | b* |
|---|---|---|---|---|---|---|---|
| Ex. 2 | $Cu_{75}Zn_{16.5}Mn_{7.5}Al_1$ | 38.1 | α | 2.1 | White | 0.23 | 12.25 |
| Ex. 3 | $Cu_{70}Zn_{18}Mn_{10}Al_2$ | 45.0 | α | Less than 1.0 | White | 0.37 | 10.42 |
| Ex. 4 | $Cu_{70}Zn_{21.5}Mn_{7.5}Al_1$ | 35.0 | α | Less than 1.0 | White | 0.03 | 12.96 |
| Ex. 6 | $Cu_{70}Zn_{19}Mn_{10}Sn_1$ | 43.3 | α | Less than 1.0 | White | 0.37 | 10.52 |
| Ex. 7 | $Cu_{75}Zn_{15.5}Mn_{7.5}Sn_2$ | 39.8 | α | Less than 1% | White | 1.58 | 14.03 |
| Ex. 8 | $Cu_{70}Zn_{20.5}Mn_{7.5}Sn_2$ | 40.0 | α | Less than 1% | White | 0.98 | 15.01 |
| Ex. 9 | $Cu_{75}Zn_{14}Mn_{10}Al_{0.2}Sn_{0.8}$ | 40.9 | α | Less than 1% | White | 1.79 | 13.87 |
| Comp Ex. 1 | $Cu_{70}Zn_{15}Mn_{10}Al_5$ | — | α + β | — | White | 0.33 | 10.21 |
| Comp Ex. 2 | $Cu_{bal}Zn_{24}Ni_{14}$ | 50.6 | β | 0.0 | White | 0.09 | 7.54 |

Embodiment 2

Using pure Cu (99.9%), pure Zn (99.9–99.99%), pure Mn (99.9%), pure Al (99.99%), and pure Sn (99.95%), batches of desired compositions for making up a 200 $cm^3$ ingot were prepared. The batches were melted in a high-frequency induction furnace in an argon atmosphere (100 mmHg) and, after holding for 4 minutes, poured into a copper casting mold (ø40 mm×28 mm). The ingots thus obtained (200 $cm^3$) were cut to a length of approximately 70 mm to make billets for extrusion. The billets were subjected to extrusion at a billet temperature of 800° C. and a container temperature of 600° C. The resultant extruded materials (ø8 mm×1300 mm) were heat-treated at 800° C. for an hour followed by cooling in the furnace (the sequence is hereafter referred to as "heat treatment"). The treated extruded materials (wire) were used to prepare test pieces.

Test pieces for the compression test and season cracking resistance evaluation were prepared from the above-extruded materials and the respective tests conducted using the same procedures as described in Embodiment 1.

The tested alloys and test results of examples of the present invention, as well as comparative examples are given in Table 2.

TABLE 2

| | Alloy compositions (wt. %) | Compression Strength 0.2% (Mpa) | Phase | Season cracking resistance (rate of elongation reduction) % | Hue | a* | b* |
|---|---|---|---|---|---|---|---|
| Example | | | | | | | |
| 1 | $Cu_{75}Zn_{18}Mn_5Al_2$ | 36.3 | α | 9.5 | Yellow | −0.78 | 21.49 |
| 2 | $Cu_{73}Zn_{20}Mn_5Al_2$ | 39.4 | α | 2.5 | Yellow | −0.96 | 16.15 |
| 3 | $Cu_{73}Zn_{21}Mn_5Al_1$ | 38.8 | α | 5.6 | Yellow | −0.88 | 15.70 |
| 4 | $Cu_{70}Zn_{24}Mn_5Al_1$ | 39.5 | α | 5.1 | Yellow | −0.93 | 15.92 |
| 5 | $Cu_{75}Zn_{18}Mn_5Sn_2$ | 36.1 | α | 1.2 | Yellow | 0.75 | 21.33 |
| 6 | $Cu_{70}Zn_{24}Mn_5Sn_1$ | 38.5 | α | 2.9 | Yellow | −0.95 | 15.53 |
| 7 | $Cu_{75}Zn_{19}Mn_{5.0}Al_{0.2}Sn_{0.8}$ | 37.0 | α | Less than 1% | Yellow | 0.85 | 15.99 |
| Comparative Example | | | | | | | |
| 1 | $Cu_{70}Zn_{20}Mn_5Al_5$ | — | α + β | — | Yellow | −1.30 | 16.52 |
| 2 | $Cu_{70}Zn_{25}Mn_5$ | 34.8 | α | 22.6 | Yellow | −0.96 | 15.00 |
| 3 | $Cu_{70}Zn_{30}$ | 42.6 | α | 29.0 | Yellow | −0.52 | 23.28 |
| 4 | $Cu_{65}Zn_{35}$ | 38.5 | α | 59.9 | Yellow | 1.45 | 22.14 |
| 5 | $Cu_{80}Zn_{20}$ | 42.8 | α | 2.8 | Yellow | 1.30 | 21.50 |

The present invention provides nickel-free copper alloys having excellent strength and hardness comparable to that of nickel silver with ductility, as well as excellent workability and corrosion resistance, with a white or yellowish appearance. The copper alloy is non-allergenic due to the absence of nickel in its constituents when used, for example, in elements, sliders, stoppers for a fastener, or in ornamental implements such as buttons, clothing fasteners, and the like, which might come in contact with the skin. Further, it has a high ornamental value, as it maintains attractive whiteness or yellowness.

What is claimed is:

1. A nickel-free copper alloy for ornamental implements consisting of a composition represented by the general formula I:

$$Cu_wZn_xMn_y(Al \text{ and } Sn)_z$$

wherein w, x, y and z denote weight percentages that are within the ranges of $70 \leqq w \leqq 85$, $[5 \leqq x \leqq 22,\ 7 < y \leqq 15]$ $15.5 \leqq x \leqq 21.5$, $7.5 \leqq y \leqq 10$, and $0 < z \leqq 4$, and unavoidable elements, wherein the alloy is in a single α-phase state at room temperature.

2. The nickel-free copper alloy according to claim 1, wherein the a* and b* values indicating the chromaticity in accordance with JIS Z 8729 are within the ranges of $0 < a^* < 2$ and $7 < b^* < 16$.

3. A nickel-free copper alloy for ornamental implements consisting of a composition represented by the general formula II:

$Cu_wZn_xMn_y(Al \text{ and } Sn)_z$ wherein w, x, y and z denote weight percentages that are within the ranges of $70 \leqq w \leqq 85$, $10 \leqq x \leqq 25$, $0 < y \leqq 7$, and $0 < z \leqq 3$, and unavoidable elements, wherein the alloy is in a single α-phase state at room temperature.

4. The nickel-free copper alloy according to claim 3, wherein the a* and b* values indicating the chromaticity in accordance with JIS Z 8729 are within the ranges of $-1.0 < a^* < 3$ and $13 < b^* < 26.0$.

* * * * *

UNITED STATES PATENT AND TRADEMARK OFFICE

CERTIFICATE OF CORRECTION

PATENT NO.: 5,997,663

DATED: December 7, 1999

INVENTORS: Kazuhiko KITA et al.

It is certified that an error appears in the above-identified patent and that said Letters Patent is hereby corrected as shown below:

Claim 1, Column 6, line 34, after "$70 \leq w \leq 85$,", delete "[$5 \leq x \leq 22$, $7 < 2y \leq 15$]

Signed and Sealed this

Eighteenth Day of July, 2000

*Attest:*

*Attesting Officer*

Q. TODD DICKINSON

*Director of Patents and Trademarks*